US005370986A

United States Patent [19]

Lok et al.

[11] Patent Number: 5,370,986

[45] Date of Patent: Dec. 6, 1994

[54] STABILIZATION OF PHOTOGRAPHIC RECORDING MATERIALS

[75] Inventors: Roger Lok; Arthur H. Herz, both of Rochester, N.Y.

[73] Assignee: Eastman Kodak Company, Rochester, N.Y.

[21] Appl. No.: 970,730

[22] Filed: Nov. 3, 1992

Related U.S. Application Data

[63] Continuation-in-part of Ser. No. 742,137, Aug. 8, 1991, abandoned, which is a continuation-in-part of Ser. No. 493,598, Mar. 5, 1990, abandoned.

[51] Int. Cl.[5] ..... G03C 1/34

[52] U.S. Cl. ..... 430/607; 430/567; 430/613; 430/614; 430/621; 430/637; 430/638; 430/639; 430/640

[58] Field of Search ..... 430/607, 613, 614, 621, 430/637, 639, 640, 638, 567

[56] References Cited

U.S. PATENT DOCUMENTS

| | | | |
|---|---|---|---|
| 2,960,404 | 11/1960 | Milton et al. | 430/638 |
| 3,185,569 | 5/1965 | Weber . | |
| 3,232,761 | 2/1966 | Allen et al. . | |
| 3,255,000 | 6/1966 | Gates, Jr. et al. . | |
| 3,301,677 | 1/1967 | Von Konig et al. | 430/531 |
| 3,312,550 | 4/1967 | Stewart et al. | 430/567 |
| 3,396,028 | 8/1968 | Humphlett | 430/607 |
| 3,520,694 | 7/1970 | Nishio et al. | 430/638 |
| 3,598,601 | 8/1971 | Beavers | 430/607 |
| 3,635,717 | 1/1972 | Ohi et al. . | |
| 3,645,743 | 2/1972 | Mucke et al. . | |
| 3,708,303 | 1/1973 | Salesin | 430/600 |
| 3,733,196 | 5/1973 | Abel et al. . | |
| 3,769,017 | 10/1973 | Sakamoto et al. . | |
| 3,861,924 | 1/1975 | Mackey et al. . | |
| 3,898,089 | 8/1975 | Yamamoto et al. | 430/626 |
| 3,936,300 | 2/1976 | Cardone . | |
| 4,161,407 | 7/1979 | Campbell . | |
| 4,193,801 | 3/1990 | Hopwood et al. | 430/613 |

FOREIGN PATENT DOCUMENTS

| | | | |
|---|---|---|---|
| 40-376 | 1/1965 | Japan | 430/639 |

OTHER PUBLICATIONS

Derwent Abstract of Japanese Patent 57-040244 (Mar. 5, 1982).

*Primary Examiner*—Janis L. Dote
*Attorney, Agent, or Firm*—Paul A. Leipold

[57] ABSTRACT

Polyhydroxyalkyl compounds and co-stabilizing agents are used to impart stabilizing or antifogging properties to photographic recording materials.

19 Claims, No Drawings

STABILIZATION OF PHOTOGRAPHIC RECORDING MATERIALS

CROSS-REFERENCE TO RELATED APPLICATION

This is a continuation-in-part of our earlier filed continuation-in-part application U.S. Ser. No. 742,137 filed on Aug. 8, 1991, now abandoned which was a continuation-in-part application of U.S. Ser. No. 493,598 filed on Mar. 5, 1990 now abandoned.

PRIOR ART

This invention relates to the stabilization of photographic recording materials. More particularly, this invention relates to stabilization of photographic silver halide recording materials using nonionic but water-soluble polyhydroxyalkyl compounds.

The use of various agents to prevent degradation of photographic light sensitive recording materials during storage is a well known practice. Usually this involves addition of the compound to the liquid silver halide emulsion which is then coated on a suitable support as a silver halide emulsion layer. For example, U.S. Pat. No 3,769,017 describes sulfur containing sugars as being effective antifogging agents for light sensitive photographic materials. The exemplified sugars are esters and can be mixed with color couplers or with high molecular weight compounds for dispersion in photographic emulsions.

From U.S. Pat. No. 3,301,677 it is known that photothermographic or heat-developable photographic materials which incorporate a polyhydric alcohol with a developer lead to improved stability and activity of the incorporated developer.

U.S. Pat. No. 3,635,717 describes use of a sulfur containing sugar compound combined with a water soluble noble metal compound to sensitize silver halide. Sensitization is said to be accomplished without accelerating fog formation during storage.

Unfortunately, sulfur containing compounds have the disadvantage of inhibiting development and causing loss in sensitivity.

U.S. Pat. No. 3,396,028 teaches that photographic emulsions which have incorporated therein derivatives of hydroxy carboxylic acids, including D-arabono-α-lactone and isobutyl-D-arabonate tetraacetate, inhibit the formation of storage fog in silver halide systems when used alone. Combinations of polyhydroxyalkyl compounds with art-recognized antifogging agents are not described.

U.S. Pat. No. 3,936,300 describes use of a glucoside humectant as a stabilizing agent to protect color diffusion transfer materials containing dye developers against fog during prolonged storage. The glucoside compound represents the reaction product of an alcohol and glucose.

U.S. Pat. No. 3,185,569 utilizes lactose added to a photosensitive layer for the purpose of increasing covering power and diminishing formation of development fog. It is noted that lactose is a reducing sugar which reacts with Fehling's solution (The Merck Index, 8th. Edition, 1968) and that no results or predictions were offered on use of this compound as a stabilizer during emulsion storage.

SUMMARY OF THE INVENTION

The present invention provides a photographic recording material comprising a support having thereon a silver halide emulsion layer which material also comprises a water-soluble nonionic polyhydroxyalkyl compound. The invention provides a photographic recording material for liquid processing comprising a support having thereon at least one chemically sensitized emulsion layer, said material comprising a water-soluble and non-ionic polyhydroxyalkyl compound comprising one of I. non-reducing oligosaccharide and its alkyl-substituted glycoside, carbon, or II. compounds having an empirical formula, $$R(CHOH)_n(CHOR')_mZ \qquad \text{Formula 1}$$

wherein n is 3 to 7, m is 0 to 7,

R is H, an alkyl group containing less than 4 carbon atoms or is a bond together with Z forming a cyclic structure, R′ is H or an alkyl group containing less than 4 carbons, Z is COL, where L is OR″ or NR′R′ wherein R″ is an alkyl group containing less than 4 carbon atoms, each R′ may be independently selected from H or an alkyl group containing less than 4 carbons, and a co-stabilizing agent.

DETAILED DESCRIPTION OF THE INVENTION

The term polyhydroxyalkyl compound as used herein only includes those compounds having 3 or more hydroxy groups and does not include diols. It is considered that the term "oligosaccharide" has a known meaning in the art. The term is used in a way such as in Fieser & Fieser ORGANIC CHEMISTRY, Reinhold Publishing Co., New York, 1956, "Carbohydrates" Chapter 14, page 350. Therein it is stated that sugars . . . are classified systematically as monosaccharides, di-, tri-, and tetrasaccharides (oligosaccharides) and polysaccharides. The term glycoside is a generic name referring to acetals derived from combinations of various hydroxy compounds with various sugars (see above reference, page 378).

Typical compounds of the invention are shown below. Table I includes compounds which fall within I.

TABLE I

| Compound No. | Name |
|---|---|
| I-1 | raffinose |
| I-2 | sucrose |
| I-3 | trehalose |
| I-4 | melezitose |

Table IIA below lists various compounds which fall within Formula I:

TABLE II

| Compound No. | Name |
|---|---|
| II-8 | methylarabonate |
| II-9 | ethylmannonate |
| II-10 | ribonamide |
| II-11 | gluconamide |
| II-13 | arabonamide |
| II-14 | mannonamide |
| II-15 | galactonamide |

Although the compounds exemplified in Tables I and II are known in the chemical art and their preparation can be found in the published literature, they generally require no multi-step synthetic procedure for their isolation. Moreover, these compounds are often commercially available as inexpensive natural product commodities of high purity. In addition to these advantages, and in contradistinction to most art-recognized emulsion stabilizers, the highly crystalline and water-soluble compounds of this invention provide remarkable protection against fog formation during storage of emulsion coatings without any substantial effects on emulsion sensitivity in either the intrinsic or the spectrally sensitized region.

The concentration of polyhydroxyalkyl compound, or mixtures thereof, can vary over a wide range. Even at relatively high concentrations these compounds provide reduced fog without appreciable loss of sensitivity. For satisfactory stabilization results from about 1 to about 1000 mmoles of compound per mole of silver halide has been found to be capable of providing the enhanced storage stability without appreciable loss of desired photographic activity. A preferred concentration is from about 50 to about 250 mmoles of polyhydroxyalkyl compound per mole of silver halide.

As noted above, fog inhibition or stabilization can be further enhanced by combining the polyhydroxyalkyl compounds described herein with recognized stabilizing or fog preventing agents. When used, these co-stabilizing or antifogging agents (hereinafter co-stabilizing agent) can be selected from the compounds discussed the technical literature, e.g. E. J. *Birr's Stabilization of Photographic Silver Halide Emulsions*, (The Focal Press, London, 1974). Among these previously recognized stabilizing antifoggants which can be used in combination with the stabilizers of this invention, are water-soluble inorganic salts and complexes illustrated in U.S. Pat. Nos. 2,566,263 and 2,839,405 and the various organic molecules with oxygen, sulfur, and nitrogen functional groups. Among the latter, hydroxy-substituted tetra- and penta-azaindenes, as well as the benzotriazoles and other azoles, have long been recognized as highly effective emulsion stabilizers and antifoggants. These compounds are nitrogen acids, DNH, or tautomers of such acids where the proton H is attached to a different atom, for example, to oxygen, but upon deprotonation in solution or in the silver halide emulsion, they can form sparingly soluble silver salts best represented by DNAg, where D represents an acyclic, cyclic, or heterocyclic residue with stabilizing properties.

Similarly included as co-stabilizers with the compounds of this invention are the previously recognized sulfur acid stabilizers, DSH. These compounds, which may also exist in different tautomeric states, are often referred to as mercaptans or thiols, can also form weakly soluble salts on replacement of the proton by a silver ion. Analogs of these sulfur acids, where an Se or Te atom is substituted for S, are also known to be useful emulsion stabilizers.

Accordingly, specially useful co-stabilizers which can be used with compounds of this invention, are represented by the formula:

II. DXH wherein

X is nitrogen, oxygen, sulfur, selenium or tellurium bound to an acyclic, cyclic or heterocyclic residue D or, optionally where D and XH are combined in one residue, and H is a proton which can be replaced by an anionic charge or by an inorganic cation, e.g., a tetramethylammonium ion or an alkali ion.

Specifically included among these sulfur, selenium and tellurium compounds which can be used advantageously in combination with this invention's polyhydroxyalkyl compounds, are the stabilizers discussed in U.S. Pat. Nos. 4,423,140 and 4,374,196 (mercaptans and thiophenols); 3,732,103, Re.28,668 (selenols); 4,546,166 and 4,578,348 (tellurols and Te compounds). Also included as co-stabilizing agents are the triazolium thiolates of U.S. Pat. No. 4,763,720, the thiosulfonate esters of U.S. Pat. No. 3,047,393, and the thiosulfonic acids and their salts proposed in U.S. Pat. Nos. 2,934,198 and 2,440,206 and DDR Patent 7376 which are further referenced and discussed in the "Review of Mechanisms of Emulsion Stabilizers and Antifogging Agents" (F. Mueller in *The Photographic Image, Formation and Structure*, S. Kikuchi, Ed., Focal Press, London, 1970, p 91).

Particularly useful co-stabilizing agents for this invention's polyhyroxyalkyl stabilizers are the various azolium salts of U.S. Pat. Nos. 2,131,038; 3,954,478; 4,237,214; 4,578,348 and the different thionamides of U.S. Pat. Nos. 2,824,001; 3,396,028; 3,536,487; 3,598,598 and 4,634,661.

The the concentration of costabilizing agent may range from about 0.05 to about 200 mmoles, preferably from about 0.15 to about 50 moles per mole of silver.

Examples of useful co-stabilizing agents are shown below:

| | |
|---|---|
| | DSH Compounds |
| DSH-1 | mercaptoacetic acid |
| DSH-2 | o-mercaptobenzoic acid |
| DSH-3 | p-toluenethiosulfonic acid, potassium salt |
| DSH-4 | o-mercapto-N-methyl-N-formylaniline |
| DSH-5 | 5-mercapto-1-phenyltetrazole |
| DSH-6 | 1-(3-acetamidophenyl)-5-mercaptotetrazole |
| | DNH Compounds |
| DNH-1 | 5-chloro-benzotriazole |
| DNH-2 | 5-(4-cyanophenyl)-tetrazole |
| DNH-3 | 4-hydroxy-6-methyl-1,3,3A,7-tetraazaindene, sodium salt |
| DNH-4 | 5-nitroindazole |
| DNH-5 | 4-hydroxy-6-methyl-2-methylthio-1,3,3A,7-tetraazaindene |

Salts of such compounds are equally useful in this invention provided they have sufficient solubility in water to accomplish the desired level of storage stability.

The polyhydroxyalkyl compound and co-stabilizing agent can be added to the sensitized emulsion composition prior to coating thereof. To the extent that such compound or compounds are water soluble, they can also be added to a layer adjacent the silver halide layer or to any other permeable layer of the photographic recording material which use is illustrated in the following examples. Any known technique for adding a soluble compound to a coating composition can be employed. It is preferred that the polyhydroxyalkyl compound be incorporated in a silver halide layer or in an adjacent layer associated therewith.

The type of silver halides to which this invention can be applied includes silver chloride, silver bromide, silver bromoiodide, silver chlorobromide, silver chloroiodide, silver chlorobromoiodide and mixtures thereof. The silver halide crystals can be coarse, medium or fine grains or mixtures thereof. The grains may be of different morphologies, e.g., spherical, cubic, cubooctahedral, tabular etc., or mixtures thereof. Grain size distribution may be monodisperse or polydisperse or mixtures thereof. This invention has been found to be particularly useful with silver chloride emulsions.

The silver halide emulsions useful in this invention, both negative-working and direct-positive types, are well known to those skilled in the art and are described in Research Disclosure, Volume 176, December 1978, Item 17643, pages 22 and 23, entitled "Emulsion preparation and types", the disclosure of which is hereby incorporated herein by reference. The emulsions are usually chemically and spectrally sensitized emulsion layers. Either conventional negative-working or direct-positive silver halide emulsions are employed. If the silver halide emulsion employed is a direct-positive silver halide emulsion, such as an internal image emulsion or a fogged, direct-positive emulsion, such as a solarizing emulsion which is developable in unexposed areas, a positive image can be obtained on the dye image-receiving layer by using negative working ballasted, redox dye-releasers.

Internal image silver halide emulsions useful in this invention are described more fully in the Nov., 1976 edition of Research Disclosure, pages 76–79, the disclosure of which is hereby incorporated by reference.

The various silver halide emulsion layers of a multicolor film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Except where noted otherwise, the silver halide emulsion layers employed in the invention comprise photosensitive silver halide dispersed in gelatin and are about 0.6 to 6 microns in thickness. The dye image-providing materials are dispersed in an aqueous alkaline solution-permeable polymeric binder, such as gelatin, as a separate layer about 0.2 to 7 microns in thickness, and the alkaline solution-permeable polymeric interlayers, e.g., gelatin, are about 0.2 to 5 microns in thickness.

The silver halide emulsions can be chemically sensitized with active gelatin, as illustrated by T. H. James, The Theory of the Photographic Process, 4th Ed., Macmillan, 1977, pp. 67–76, or with sulfur, selenium, tellurium, gold, platinum, palladium, iridium, osmium, rhenium or phosphorus sensitizers or combinations of these sensitizers. Advantageous chemical sensitivity is also obtained in emulsions having pAg values of from 5–10, pH levels of from 5–8 and temperatures of from 30°–80° C., as illustrated by Research Disclosure, Vol. 120, April 1974, Item 12008, Research Disclosure, Vol. 134, June 1975, Item 13452, by Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U. K. Patent 1,396,696. Chemical sensitization being optionally conducted in the presence of thiocyanate derivatives, as described in Damschroder U.S. Patent 2,642,361, thioether compounds, as disclosed in Lowe et al U.S. Pat. No. 2,521,926, Williams et al U.S. Pat. No. 3,021,215 and Bigelow U.S. Pat. No.4,054,457 and azaindenes azapyridazines and azapyrimidines, as described in Dostess U.S. Pat. No. 3,411,914, Kuwabara et al U.S. Pat. No. 3,443,757, Oguchi et al U.S. Pat. No. 3,565,631 and Oftedahl U.S. Pat. No. 3,901,714. Additionally or alternatively, the emulsions can be reduction sensitized—e.g. with hydrogen, as illustrated by Janusonis U.S. Pat. No. 3,891,446 and Babcock et al U.S. Pat. No. 3,984,249 by low pAg (e.g. less than 5) high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al Research Disclosure, Vol. 136, August 1975, Item 13654, Lowe et al; U.S. Pat. Nos. 2,518,698 and 2,739,060, Roberts et al U.S. Pat. No. 2,743,182 and '183, Chambers et al U.S. Pat. No. 3,026,203 and Bigelow et al U.S. Pat. No. 3,361,564.

Before coating it on a support, the silver halide emulsion is generally adjusted to contain between about 0.01–30 mM soluble halide ions such as alkali halide, the preferred range being between about 0.1–3.0 mM soluble halide. Although the emulsion is generally coated from a weakly acidic environment, often in the approximate range pH 5–7, the emulsion may also be coated at lower pH and lower pAg values as illustrated in the Evans Research Disclosure #15560 of March, 1977. The supports for the photographic elements used in this invention can be any material, as long as it does not deleteriously affect the photographic properties of the film unit and is dimensionally stable. Typical flexible sheet materials are described on page 85 of the November, 1976 edition of Research Disclosure, the disclosure of which is hereby incorporated by reference.

The recording materials of the invention are developable in liquid chemical developers. They are suitable for developing in the conventional RA-4 or hydroquinone liquid process.

The following examples provide data for the concept of incorporating polyhydroxyalkyl compounds into coating compositions (i.e., emulsion melts) to obtain improved storage stability. However, these conditions should not be considered to be a limitation on the concept of this invention. EXAMPLE 1

A polydispersed AgBrI (6 mole % iodide) gelatin emulsion was treated with thiosulfate and chloroaurate ions to achieve chemical sensitivity. Then the emulsion was spectrally sensitized with the anionic dye 5,5'-dichloro-9-ethyloxacarbocyanine. Water solutions of the test compound were then added to portions of this emulsion before coating it on a transparent base at 40° C., pH 5.8 and pAg 8.4. Coverage per $ft^2$ was about 0.45 g silver and 1 g ossein gelatin (IP 4.9). Samples of the dried coating were sensitometrically exposed through appropriate light filters in their fresh state and also after storage for 1 or 2 weeks at 49° C., 50% RH; they were processed for 4 minutes in conventional KODAK liquid devloper D-19 followed by appropriate fix, wash and drying procedures. In addition to densitometric evaluation of these developed coatings, unprocessed dry coatings were also examined spectrophotometrically to determine their percent absorptance (A) at the dye's aggregate band near 550 nm. Results are reported below.

TABLE 3

| Compound No. mmole/Ag mole | % Absorbance | Fresh Coating Green Speed* | Fog Fresh | Fog 1 Week |
|---|---|---|---|---|
| None (control) | 58 | 100 | 0.09 | 0.35 |
| I-2, 200 | 57.6 | 102 | 0.07 | 0.19 |

*Speeds are normalized with respect to the fresh control.

The results of Example I make it evident that compounds of this invention restrain the formation of storage fog without deleterious effects on emulsion sensitivity or on the characteristic aggregate absorptance of the spectral sensitizing dye compound.

EXAMPLE 2

The same emulsions were used as in Example 1, except that the emulsions were coated at pH 5.5 and pAg 8.5.

TABLE 4

| Compound No. mmole/Ag mole | % Absorbance | Fresh Coating Speed* | Fresh Coating Fog | 2 week, Storage Speed* | 2 week, Storage Fog |
|---|---|---|---|---|---|
| None (control) | 57 | 100 | 0.10 | 20.5 | 1.19 |
| DNH-5, 0.3 (comparison) | 52.2 | 68 | 0.09 | 47 | 0.86 |
| I-2, 150 | 56 | 105 | 0.09 | 62 | 0.75 |

*Speeds are normalized with respect to the fresh control.

The data listed in Example 2 demonstrate that in contrast to a prior art stabilizer, a compound of this invention reduces both speed loss and fog during emulsion storage. Moreover, this desirable behavior is not accompanied by either loss of original sensitivity or by substantial change in the surface aggregation of the sensitizing dye.

EXAMPLE 3

To aliquots of a chemically and spectrally sensitized 0.44 micron cubic AgCl emulsion in a 0.4% ossein gelatin, water solutions of the test compounds were added at 40° C. The emulsions were adjusted to DH 5.6 and pCl before being coated at a coverage of 0.25 g silver and 0.425 g gelatin per $ft^2$. Samples of the dried coatings were sensitometrically exposed to the 365 Mercury line in their fresh state and also after storage at 49° C., 50% RH. The coatings were then processed for 5 minutes in a conventional liquid chemical developer KODAK developer DK-50 followed by appropriate fix, wash, drying and sensitometric procedures. Results are shown below.

TABLE 5

| Compound No. (50 mmole/mole Ag) | Fresh Coating Speed* | Fresh Coating Fog | 1 week Storage Fog |
|---|---|---|---|
| None (control) | 100 | 0.05 | 0.54 |
| I-2 | 95 | 0.06 | 0.23 |

*Speeds are normalized with respect to the fresh control.

These results make it apparent that the compounds of this invention can inhibit the formation of storage fog in a fully sensitized AgCl emulsion without deleterious loss of emulsion sensitivity.

EXAMPLE 4

Utilizing silver chloride emulsions as described above in Example 3, polyhydroxyalkyl compounds, were tested for their ability to restrain storage fog. The results of this test appear below in Table 6A. These same compounds were also tested with the use of the costabilizing agent DSH-6, as identified above, at 0.38 mmoles/mole Ag. Results are shown in Table 6B.

TABLE 6A (No Co-Stabilizing Agent)

| Compound No. (208 mmole/mole Ag) | Fresh Coating Speed | Fresh Coating Fog | Fog, 1 week @ 30.8° C./50% RH |
|---|---|---|---|
| None (Control) | 100 | 0.04 | 0.57 |
| I-1 | 107 | 0.05 | 0.30 |
| I-2 | 107 | 0.05 | 0.34 |

TABLE 6B (Including Co-Stabilizing Agent)

| Compound No. (208 mmole/mole Ag) | Fresh Coating Speed | Fresh Coating Fog | Fog, 3 days @ 60° C./50% RH |
|---|---|---|---|
| None (Control) | 100 | 0.02 | 0.41 |
| I-1 | 102 | 0.02 | 0.34 |
| I-2 | 102 | 0.02 | 0.33 |

It is apparent that even in the presence of a conventional thiol stabilizer, the polyhydroxyalkyl compounds of this invention reduce the formation of storage fog without causing adverse changes in sensitivity.

EXAMPLE 5

The enhanced advantages obtained by incorporating a co-stabilizing agent into a photographic recording material which also contains a polyhydroxyalkyl compound according to this invention are further illustrated in this example. Silver chloride emulsions, as described above in Example 3, were prepared with and without the co-stabilizing agent DSH 6, as identified above, at 0.38 mmole/mole Ag. The indicated polyhydroxyalkyl compounds were used at 208 mmoles/mole Ag. Development was carried out using the conventional liquid chemical development of Kodak RA-4. Fog stability tests were made on fresh coatings as well as on coatings held at 40.9° C./50% RH for 1 week. Results are shown in Table 7.

TABLE 7

| Compound No. | Fresh Coating Speed | Fresh Coating Fog | 1 Week Storage Fog |
|---|---|---|---|
| None (Control*) | 100 | 0.13 | 1.24 |
| II-11 | 110 | 0.14 | 0.60 |
| DSH-6 | 166 | 0.07 | 0.15 |
| DSH-6 + II-11 | 162 | 0.06 | 0.08 |

*Without co-stabilizer

As can be seen from Table 7 the added use of the co-stabilizing agent with polyhydroxyalkyl compounds results in fog decreases with respect to both fresh coatings and coatings subjected to storage at elevated heat/-humidity conditions. Moreover, increases in speed relative to the control are also apparent.

The invention has been described in detail with particular reference to preferred embodiments thereof, but it will be understood that variations and modifications can be effected within the spirit and scope of the invention.

We claim:

1. A photographic recording material for liquid processing comprising a support having coated thereon at least one chemically sensitized silver chloride emulsion layer having a pH of 5–7, said material comprising a co-stabilizing agent and a water-soluble non-ionic polyhydroxyalkyl compound comprising non-reducing oligosaccharide or its alkyl-substituted glycoside.

2. The material of claim 1 wherein said compound comprises sucrose.

3. The material of claim 1 wherein said compound comprises raffinose.

4. The material of claim 1 wherein said co-stabilizing agent comprises 4-hydroxy-6-methyl-2-methylthio-1,3,3A,7-tetraazaindine.

5. The material of claim 1 wherein said co-stabilizing agent comprises 1-(3-acetamidophenyl)-5-mercaptotetrazole.

6. The material of claim 1 wherein said compound is present in an amount of from about 50 to about 250 mmole/mole of silver halide.

7. The material of claim 1 wherein said compound is in the emulsion layer.

8. The material of claim 1 wherein said compound is present in a hydrophilic layer adjacent said emulsion layer.

9. The material of claim 1 wherein said co-stabilizer is in said emulsion layer.

10. A photographic recording material for liquid processing comprising a support having coated thereon at least one chemically sensitized silver halide emulsion layer having a pH of 5–7, said material comprising a co-stabilizing agent and a water-soluble non-ionic polyhydroxyalkyl compound having an empirical formula, $$R(CHOH)_n(CHOR')_mZ$$

wherein n is 3 to 7, m is 0 to 7,

R′ is H, or an alkyl group containing less than 4 carbon atoms,

R is H or an alkyl group containing less than 4 carbons,

Z is COL, where

L is OR″ or NR′R′ wherein R″ is an alkyl group containing less than 4 carbon atoms, and R′ is H or an alkyl group containing less than 4 carbons.

11. The material of claim 10 wherein said co-stabilizing agent comprises 4-hydroxy-6-methyl-2-methylthio-1,3,3A,7-tetraazaindine.

12. The material of claim 10 wherein said co-stabilizing agent comprises 1-(3-acetamidophenyl)-5-mercaptotetrazole.

13. The material of claim 10 wherein said compound is present in an amount of from about 50 to about 250 mmole/mole of silver halide.

14. The material of claim 10 wherein said compound is in the emulsion layer.

15. The material of claim 10 wherein said compound is present in a hydrophilic layer adjacent said emulsion layer.

16. The material of claim 10 wherein said co-stabilizer is in said emulsion layer.

17. The material of claim 10 wherein said emulsion layer comprises silver chloride.

18. The material of claim 10 wherein said compound comprises gluconamide.

19. The material of claim 10 wherein R′ is an alkyl of 1 carbon.

* * * * *